US009145789B2

(12) United States Patent
Adavikolanu et al.

(10) Patent No.: US 9,145,789 B2
(45) Date of Patent: Sep. 29, 2015

(54) IMPINGEMENT PLATE FOR DAMPING AND COOLING SHROUD ASSEMBLY INTER SEGMENT SEALS

(75) Inventors: Siva Ram Surya Sanyasi Adavikolanu, Karnatake (IN); Ajay Gangadhar Patil, Greer, SC (US); Debdulal Das, Karnataka (IN); Richa Singh, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 538 days.

(21) Appl. No.: 13/604,322

(22) Filed: Sep. 5, 2012

(65) Prior Publication Data

US 2014/0064913 A1 Mar. 6, 2014

(51) Int. Cl.
*F01D 11/24* (2006.01)
*F01D 25/04* (2006.01)

(52) U.S. Cl.
CPC ..... *F01D 11/24* (2013.01); *F01D 25/04* (2013.01); *F05D 2240/11* (2013.01); *F05D 2260/201* (2013.01)

(58) Field of Classification Search
CPC ..... F01D 11/006; F01D 11/08; F01D 11/24; F01D 25/24; F01D 25/04; F01D 25/08; F04D 29/668; F05D 2240/11; F05D 2260/201; F05D 2260/202
See application file for complete search history.

(56) References Cited

U.S. PATENT DOCUMENTS

| | | | | |
|---|---|---|---|---|
| 5,188,507 | A * | 2/1993 | Sweeney | 415/173.1 |
| 5,533,864 | A * | 7/1996 | Nomoto et al. | 416/96 A |
| 6,402,466 | B1 * | 6/2002 | Burdgick et al. | 415/173.3 |
| 6,508,623 | B1 * | 1/2003 | Shiozaki et al. | 415/173.1 |
| 6,899,513 | B2 | 5/2005 | Eleftheriou | |
| 2008/0211192 | A1 * | 9/2008 | Pietraszkiewicz et al. | 277/347 |

* cited by examiner

*Primary Examiner* — Edward Look
*Assistant Examiner* — Jesse Prager
(74) *Attorney, Agent, or Firm* — Nixon & Vanderhye P.C.

(57) ABSTRACT

An impingement plate is cooperable with a shroud assembly. The shroud assembly includes an outer shroud and plural inner shrouds with seals between the plural inner shrouds, respectively. The impingement plate includes a trailing edge portion, a leading edge portion and a mid portion between the trailing edge portion and the leading edge portion. A plurality of impingement holes are formed across an area of the impingement plate, and a cooling and damping section includes at least one channel that is shaped to accelerate cooling flow through the impingement plate.

15 Claims, 4 Drawing Sheets

IMPINGEMENT PLATE FOR DAMPING AND COOLING SHROUD ASSEMBLY INTER SEGMENT SEALS

BACKGROUND OF THE INVENTION

The invention relates generally to an impingement plate in a turbine shroud assembly.

In industrial gas turbines, shroud segments are fixed to turbine shell hooks in an annular array about the turbine rotor axis to form an annular shroud radially outwardly of and adjacent the tips of buckets forming part of the turbine rotor. The inner wall of the shroud defines part of the gas path. Conventionally, the shroud segments are comprised of inner and outer shrouds provided with complimentary hooks and grooves adjacent to their leading (forward) and trailing (aft) edges for joining the inner and outer shrouds to one another. The outer shroud is, in turn, secured to the turbine shell or casing. Typically, each shroud segment has one outer shroud and two or three inner shrouds.

The shrouds prevent the turbine shell from being exposed to the hot gas path. The shrouds, especially in the first and second stages, are exposed to very high temperatures of the hot gas in the hot gas path and have heat transfer coefficients that are also very high due to the rotation of the turbine blades. Inner shrouds are made from high temperature resistant material and are exposed to the hot gas path. The inner shrouds may also have thermal boundary coatings. The outer shrouds are made from lower temperature resistant and lower cost materials compared to the inner shrouds. To cool the inner and outer shrouds, cold air from the compressor is used.

Different cooling and sealing methods are used. The most common method is impingement cooling to cool the radially outer side of the inner shroud. An impingement plate may be interposed between the inner and outer shrouds to distribute the cooling air.

Each outer shroud in the shroud assembly may include multiple inner shrouds with inter segment seals between them. The inter segment seals, however, are subject to HCF failures due to bucket pulsations. Additionally, the seals have a tendency to fail in the mid to leading edge span of the seal due to high oxidation damage. The damage results from hot gas ingestion that thereby raises the temperature of the seals. Existing designs have no dedicated cooling for the inter segment seals between the inner shrouds in a shroud assembly.

BRIEF DESCRIPTION OF THE INVENTION

In an exemplary embodiment, an impingement plate is cooperable with a shroud assembly. The shroud assembly includes an outer shroud and plural inner shrouds with seals between the plural inner shrouds, respectively. The impingement plate includes a trailing edge portion, a leading edge portion and a mid portion between the trailing edge portion and the leading edge portion. A plurality of impingement holes are formed across an area of the impingement plate, and a cooling and damping section includes at least one channel that is shaped to accelerate cooling flow through the impingement plate.

In another exemplary embodiment, a shroud assembly includes an outer shroud including outer shroud hooks at an inner end thereof, plural inner shrouds including connecting structure securable to the outer shroud hooks, and a seal connected between adjacent ones of the plural inner shrouds. An impingement plate with a cooling and damping section is disposed between the outer shroud and the plural inner shrouds.

In still another exemplary embodiment, a method of cooling and dampening seals between inner shrouds in a shroud assembly includes the steps of (a) interposing an impingement plate between an outer shroud and the inner shrouds; (b) directing cooling air through the impingement plate; and (c) accelerating the cooling air through the impingement plate adjacent the seals.

DETAILED DESCRIPTION OF THE INVENTION

Although the invention will be described with reference to an industrial gas turbine, the invention is applicable in other environments as would be appreciated by those of ordinary skill in the art. The invention is thus not meant to be limited to gas turbines.

Figure 1:
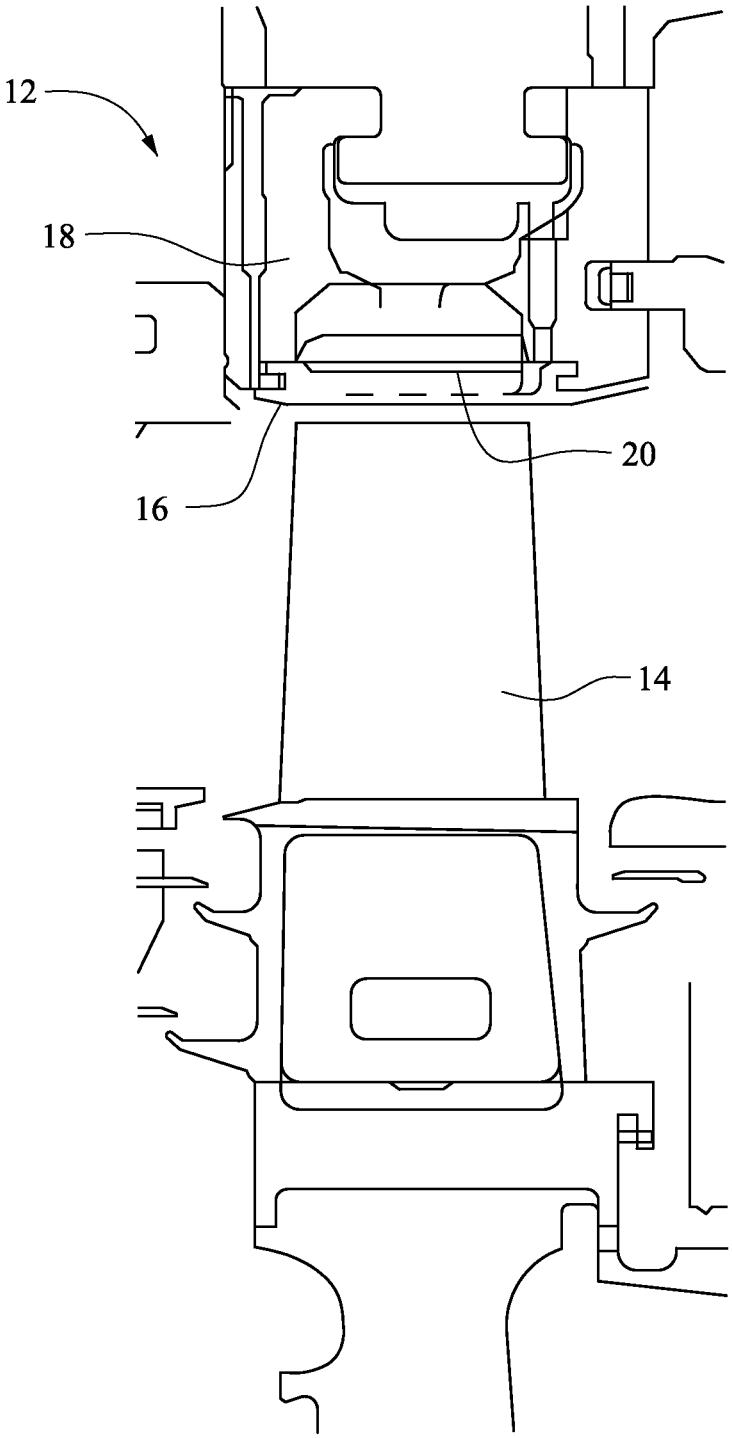
FIG. 1 shows a section of a gas turbine including a turbine bucket and a shroud assembly.
Figure 2:
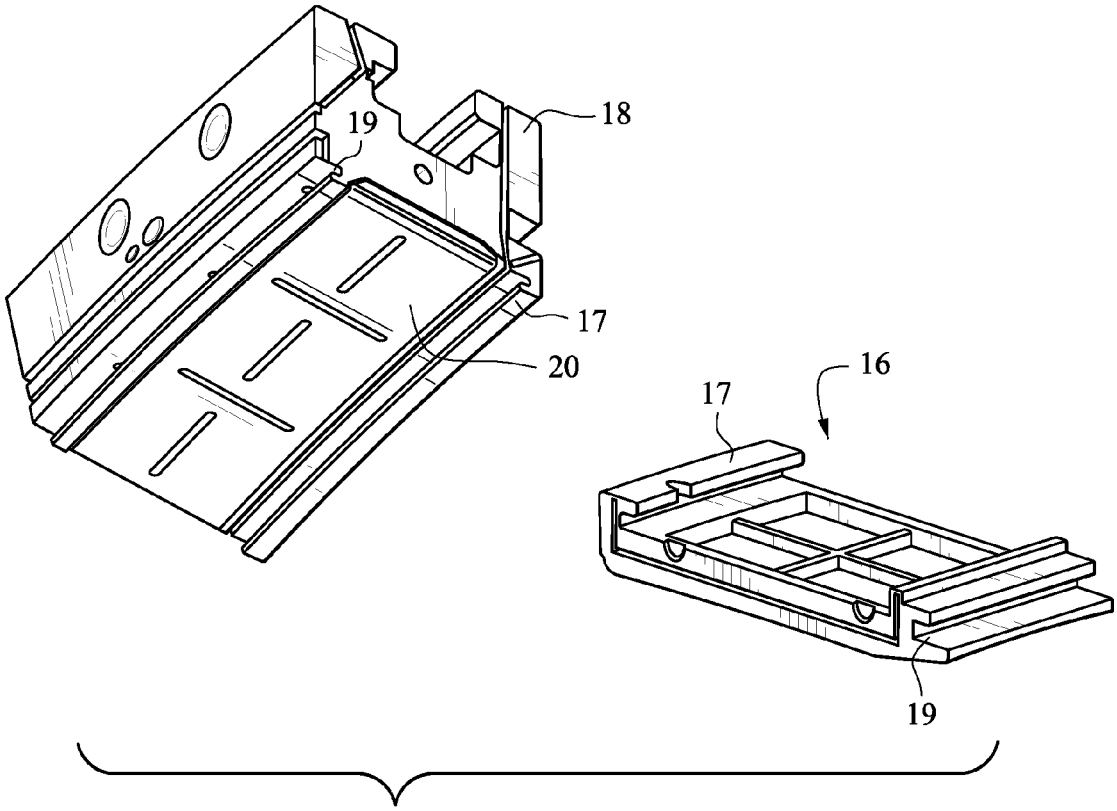
FIG. 2 shows the parts of the shroud assembly.

With reference to FIGS. 1 and 2, in an industrial gas turbine, shroud segments or shroud assemblies 12 are fixed to turbine shell hooks in an annular array about the turbine rotor axis to form an annular shroud radially outwardly of and adjacent the tips of buckets 14 forming part of the turbine rotor. Conventionally, the shroud segments are comprised of inner 16 and outer 18 shrouds provided with complimentary hooks 17 and grooves 19 adjacent their leading (forward) and trailing (aft) edges for joining the inner and outer shrouds to one another. The outer shroud 18 is secured to the turbine shell or casing. In use, to cool the inner and outer shrouds, cold air from the compressor is used. Impingement cooling may be used to cool the radially outer side of the inner shroud 16. An impingement plate 20 may be welded to the outer shroud 18 and interposed between the inner and outer shrouds to distribute the cooling air.

Figure 3:
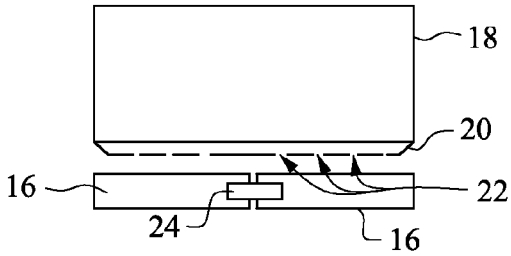
Figure 3 (Prior Art)
FIG. 3 is an existing configuration for inner shroud cooling.

With reference to FIG. 3, in the existing shroud assembly, discharge air flows through the impingement plate 20 via holes 22. In one arrangement, the discharge air comes through a hole provided in a hula seal to cool the combustion liner by the impingement plate 20. In this process, the hula seal is also cooled by the same discharge air kept in the plenum. In the existing configuration, however, inter segment seals 24 between the inner shrouds may be subjected to HCF failures due to inadequate cooling and pulsations from the turbine bucket.

Figure 4:
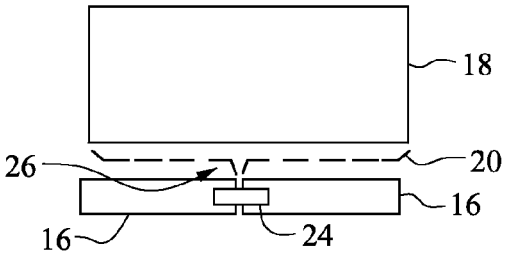
FIG. 4 is a schematic illustration showing the inner shroud cooling configuration of the described embodiments.

As shown schematically in FIG. 4, the impingement plate 20 according to the described embodiments is provided with a cooling and damping section 26 in the form of a nozzle or the like adjacent the inter segment seals 24 between the inner shrouds 16. The cooling and damping section 26 provides secondary flows that will impinge on the seal 24 directly with increased velocity. The high velocity air flow provides damping from the cooling side of the seal 24 that withstands and dampens the bucket pulsations to avoid HCF issues. That is, increasing the amount of cooling air on the seals will increase the pressure acting on the seals and results in improved back flow margins and hence dampens the bucket pulsations. Additionally, the cooling and damping section 26 provides for direct cooling of the seal 24, which will avoid oxidation problems that currently exist. An advantageous consequence of the cooling and damping section 26 is the resulting additional stiffness to the impingement plate 20, which can eliminate any lifting issues on the impingement plate 20.

Figure 5:
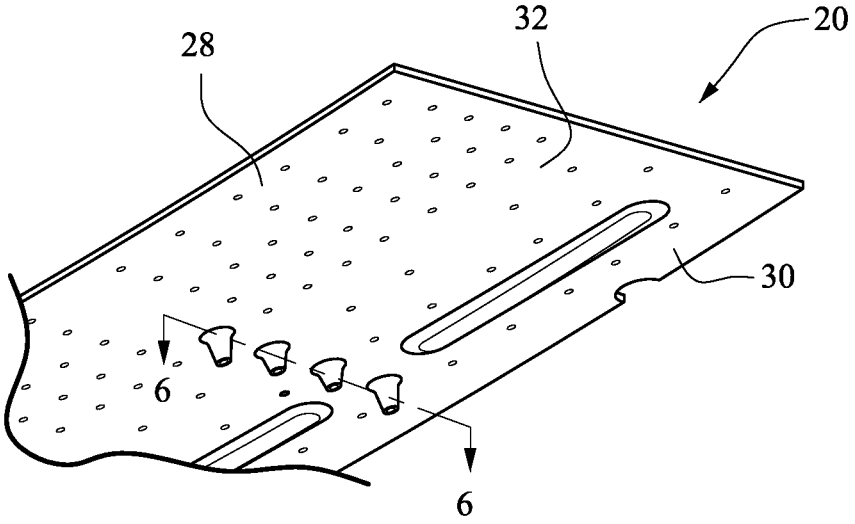
FIGS. 5 and 6 show an impingement plate with conical holes.
Figure 6:
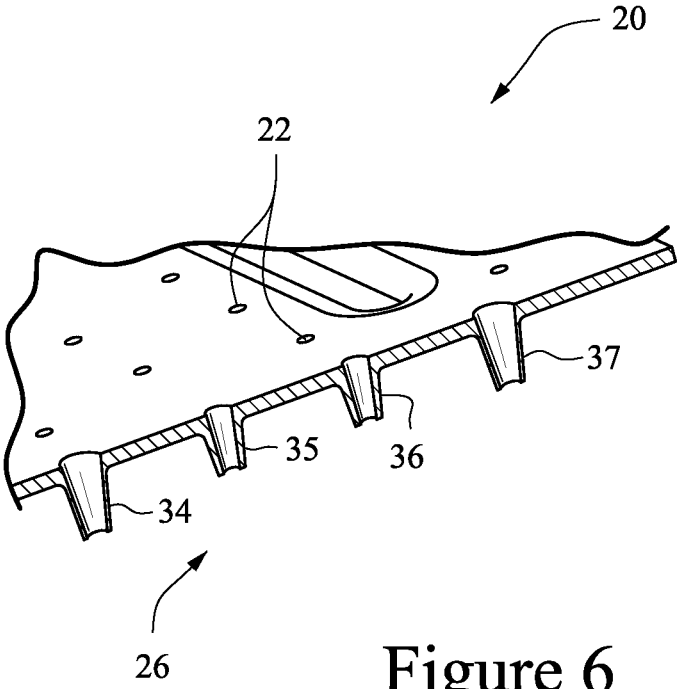

FIGS. 5 and 6 show an exemplary configuration of the impingement plate 20 including the cooling and damping section 26. As shown, the impingement plate 20 includes a trailing edge portion 28, a leading edge portion 30, and a mid portion 32 between the trailing edge portion 28 and the leading edge portion 30. The impingement holes 22 are formed across an area of the impingement plate 20. The cooling and damping section 26 includes at least one channel that is shaped to accelerate cooling flow through the impingement plate 20.

FIG. 5 shows an underside of the impingement plate 20, and FIG. 6 is a sectional view through A-A in FIG. 5. Preferably, the cooling and damping section 26 extends from the leading edge portion 30 to the mid portion 32.

In order to accelerate the cooling flow through the impingement plate 20, the at least one channel comprises a converging diameter in a flow direction. In the embodiment shown in FIGS. 5 and 6, the cooling and damping section 26 includes a series of conical channels 34-37. The conical channels 34-37 are sized according to an amount of damping desired at the plural inner shrouds 16 adjacent the impingement plate 20. As such, the amount of cooling/damping can be "tuned" based on the turbine design. In the exemplary embodiment shown in FIGS. 5 and 6, conical channels 34 and 37 are larger than conical channels 35 and 36.

Figure 7:
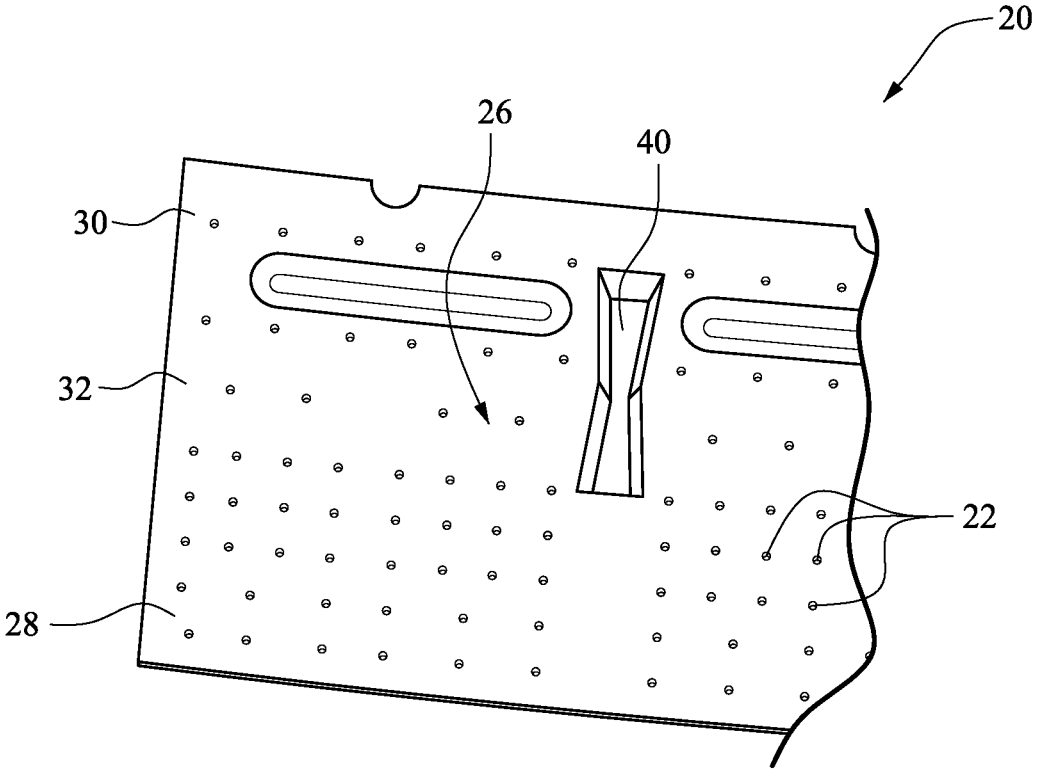
FIG. 7 shows an impingement plate with a trapezoidal channel.

FIG. 7 shows an alternative embodiment for the impingement plate 20. In FIG. 7, the cooling and damping section 26 comprises a trapezoidal shaped channel 40. As shown, the trapezoidal shaped channel 40 extends from the leading edge portion 30 to the mid portion 32.

The improved impingement plate and shroud assembly serves to dampen turbine bucket pulsations, thereby reducing vibrations at the inter segment seals between inner shrouds and consequently reducing or eliminating failures due to HCF. Additionally, the dedicated cooling for the seals reduces high oxidation damage caused by hot gas ingestion during turbine use. The structure also minimizes impingement plate cracks, thereby reducing repair costs. Still further, the arrangement increases seal life and consequently the useful life of the inner shrouds, thereby significantly reducing repair cycles and outage issues.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An impingement plate cooperable with a shroud assembly, the shroud assembly including an outer shroud and plural inner shrouds with seals between the plural inner shrouds, respectively, the impingement plate comprising:

a trailing edge portion, a leading edge portion and a mid portion between the trailing edge portion and the leading edge portion;

a plurality of impingement holes formed across an area of the impingement plate; and a cooling and damping section including at least one channel that is shaped to accelerate cooling flow through the impingement plate, wherein the cooling and damping section is positioned to direct cooling air to the seals between the plural inner shrouds.

2. An impingement plate according to claim 1, wherein the cooling and damping section is shaped to dampen bucket pulsation from a cooling side of the seals.

3. An impingement plate according to claim 1, wherein the cooling and damping section extends from the leading edge portion to the mid portion.

4. An impingement plate cooperable with a shroud assembly, the shroud assembly including an outer shroud and plural inner shrouds with seals between the plural inner shrouds, respectively, the impingement plate comprising:

a trailing edge portion, a leading edge portion and a mid portion between the trailing edge portion and the leading edge portion;

a plurality of impingement holes formed across an area of the impingement plate; and a cooling and damping section including at least one channel that is shaped to accelerate cooling flow through the impingement plate, wherein the at least one channel comprises a converging diameter in a flow direction.

5. An impingement plate according to claim 4, wherein the cooling and damping section comprises a series of conical channels.

6. An impingement plate according to claim 5, wherein the series of conical channels extends from the leading edge portion to the mid portion.

7. An impingement plate according to claim 6, wherein the conical channels in the series of conical channels are sized according to an amount of damping desired at the plural inner shrouds adjacent the impingement plate.

8. An impingement plate according to claim 7, wherein at least one of the conical channels in the series of conical channels is sized differently than others of the conical channels.

9. An impingement plate according to claim 4, wherein the cooling and damping section comprises a trapezoidal shaped channel.

10. An impingement plate according to claim 9, wherein the trapezoidal shaped channel extends from the leading edge portion to the mid portion.

11. A shroud assembly comprising:

an outer shroud including outer shroud hooks at an inner end thereof;

plural inner shrouds including connecting structure securable to the outer shroud hooks;

a seal connected between adjacent ones of the plural inner shrouds; and an impingement plate disposed between the outer shroud and the plural inner shrouds, wherein the impingement plate comprises:

a trailing edge portion, a leading edge portion and a mid portion between the trailing edge portion and the leading edge portion, a plurality of impingement holes formed across an area of the impingement plate, and a cooling and damping section including at least one channel that is shaped to accelerate cooling flow through the impingement plate, wherein the cooling and damping section is positioned to direct cooling air to the seal between the plural inner shrouds.

12. A shroud assembly according to claim 11, wherein the cooling and damping section is shaped to dampen bucket pulsation from a cooling side of the seal.

13. A shroud assembly according to claim 11, wherein the cooling and damping section extends from the leading edge portion to the mid portion.

14. A shroud assembly according to claim 11, wherein the at least one channel comprises a converging diameter in a flow direction.

15. A method of cooling and dampening seals between inner shrouds in a shroud assembly, the method comprising:

(a) interposing an impingement plate between an outer shroud and the inner shrouds;

(b) directing cooling air through the impingement plate; and (c) accelerating the cooling air through the impingement plate adjacent the seals, wherein step (c) is practiced by providing a cooling and damping section in the impingement plate and by forming at least one channel through the impingement plate, the channel having a converging diameter in a flow direction.

* * * * *